United States Patent [19]

Ishiwata et al.

[11] 4,292,349

[45] Sep. 29, 1981

[54] COATING METHOD AND APPARATUS

[75] Inventors: Mamoru Ishiwata; Shinji Uematsu; Kazuo Ozaki; Masashi Ishiyama, all of Minami-ashigara, Japan

[73] Assignee: Fuji Photo Film Co., Ltd., Minami-ashigara, Japan

[21] Appl. No.: 99,232

[22] Filed: Nov. 30, 1979

[30] Foreign Application Priority Data

Dec. 6, 1978 [JP] Japan ..... 53-151222

[51] Int. Cl.[3] ..... B05D 3/10

[52] U.S. Cl. ..... 427/335; 118/410; 118/423; 118/428; 118/429

[58] Field of Search ..... 427/336, 335; 118/410, 118/423, 428, 429

[56] References Cited

U.S. PATENT DOCUMENTS 3,418,970 12/1968 Phelps et al. ..... 118/410
3,518,964 7/1970 Nagler ..... 118/410
3,690,917 9/1972 Hershoff et al. ..... 118/410

FOREIGN PATENT DOCUMENTS 1455540 11/1976 United Kingdom ..... 118/410

*Primary Examiner*—Ronald H. Smith
*Assistant Examiner*—Janyce A. Bell
*Attorney, Agent, or Firm*—Sughrue, Mion, Zinn, Macpeak & Seas

[57] ABSTRACT

Apparatus and method for applying a high volatility liquid to a moving web to form a coating on the web. The coating liquid is applied to the web through an extrusion-type or slide-type hopper covered by a hood which collects evaporated gas from the applied solvent at a region at which a solid-, liquid-, and gas-phase interface of the coating liquid is formed. The collected gas is utilized to suppress further gas evaporation from the three-phase interface thereby preventing the formation of stripe-like defects due to undesirable solidification of the forming liquid.

11 Claims, 5 Drawing Figures

COATING METHOD AND APPARATUS

BACKGROUND OF THE INVENTION

The invention relates to a method for coating a web being conveyed with a film forming material and an apparatus for practicing this method. More particularly, the invention relates to a method for coating a web with a film forming material including a coating liquid of organic solvent of high volatility in which the coating operation is stable over long periods of time and an apparatus for practicing this method.

The term "web" as herein used is intended to mean a belt-shaped supporting member which is made of a polyester such as polyethyleneterephthalate, polyethylene-2 and 6-napththalate, or polyolefins such as for instance polypropylene, or cellose derivatives such as cellose triacetate and cellose diacetate, or plastics such as polycarbonate, or ceramics such as glass and porcelain, or paper such as baryta paper or synthetic paper, the thickness being approximately in the range of 2 to 300$\mu$.

The term "coating liquid of organic solvent system of high volatility" as herein used is intended to mean one which contains a solid component which may be separately chosen according to its intended use, such as film forming materials for magnetic recording mediums or photosensitive materials. In the coating liquid, the mixing ratio of any one of the organic solvents to the solid component is extremely large, the organic solvents being used as solvents in coating the web with the coating liquid. The coating liquid is applied directly or through other coated films to the web, usually to a thickness of 5 to 500$\mu$ (measured before the film is dried).

The aforementioned organic solvents may, for example, be ketones such as acetone, methylethyl ketone, methylisobutyl ketone and cyclohexanone; alcohols such as methanol, ethanol, propanol and butanol; esters such as methyl acetate, ethyl acetate, butyl acetate, ethyl lactate and glycol monoethylether acetate; glycolethers such as ether, glycoldimethylether, glycolmonoethylether and dioxane; tars (aromatic hydrocarbons) such as benzen, toluene and xylene; and chlorinated hydrocarbons such as methylene chloride, ethylene chloride, carbon tetrachloride, chloroform, ethylene chlorohydrin and dichlorobenzen.

A coating method and a coating apparatus for producing a coated film which of high quality and especially is free from stripe-like defects using a coating liquid containing organic solvent as described above (hereinafter referred to merely as "a coating liquid", when applicable) have been proposed in Japanese Laid-Open Patent Application No. 93606/1975 which discloses an extrusion-type hopper in which one lip or edge on the web entry side of the hopper is set back from the other lip or edge away from the web.

Another extrusion-type hopper has been disclosed by Japanese Laid-Open Patent Application No. 142643/1975 in which a liquid collecting recess is provided in the edge or lip in the vicinity of the coating point and downstream thereof, that is, in the vicinity of the bridge of the coating liquid which is called the meniscus, bead or ribbon and which is formed between the edge and the web.

Both of these extrusion-type hoppers are considered effective in reducing the solidified accumulations of the coating liquid which are created when the coating liquid containing an organic solvent at a high mixing ratio and high volatility evaporates while it is in contact with the solid surfaces of the hopper. Thus, an extrusion-type hopper can effectively suppress the occurrence of stripe-like defects in the longitudinal direction of the coated film, that is, in the direction of advancement of the web.

However, first-described extrusion-type hoppers are nonetheless disadvantageous in the following points. The means employed for recovering excess amounts of coating liquid and the means employed for treating the coating liquid for reuse are rather intricate. Furthermore, the techniques used for preventing solidification of the coating liquid due to evaporation during recovery are not sufficient.

On the other hand, the second-described extrusion-type hopper suffers from the following problems. When the joining point of new and old webs passes through the coating point, the meniscus or bead is greatly disturbed depending on the conditions of the joint. Furthermore, the coating liquid oozes abruptly into the aforementioned recess thus accelerating the creation of additional solidified accumulations. Therefore, it is necessary to carefully and positively join the new and old webs. That is, the new web must be satisfactorily connected to the old web at all times. For this purpose, it is required that a web accumulator of larger capacity be provided or the speed of movement of the web must be reduced.

Accordingly, the inventors have conducted intensive research on conventional extrusion-type hoppers using an organic solvent system coating liquid with a view of improving them. Furthermore, the inventors have performed experiment and analysis on slide-type hoppers which are capable of coating relatively low viscosity photosensitive silver halogenide emulsion as a thin layer, as has been disclosed in U.S. Pat. Nos. 2,761,417, 2,761,791, 2,975,754, 3,005,440 and 3,735,729, in order to improve the hoppers so as to make them capable of stably coating webs with the above-described organic solvent system coating liquid of high volatility. As a result, the inventors have produced the present invention, namely a coating method and a coating apparatus which are suitable for coating webs with the above-described organic solvent system coating liquids according to a so-called "hopper coating method" including extrusion-type hoppers and slide-type hoppers.

Accordingly, an object of this invention is to provide a novel coating method and a coating apparatus for practicing this method in which all of the above-described difficulties accompanying a conventional extrusion-type hopper have been eliminated, a conventional slide-type hopper which has been used specially for other coating liquids is made acceptable for use with the above-described coating liquids, the occurence of the above-described stripe-like defects in the coated film is prevented, and the coating operation can be continued stably for a longer period of time.

SUMMARY OF THE INVENTION

The foregoing object and other objects of the invention have been achieved by the provision of a coating method and an apparatus for practicing this method in which a coated film is formed on a web by applying a coating liquid of an organic solvent system of high volatility directly or through other coated films thereto by means of an extrusion-type hopper or a slide-type hopper while the web the direction of movement is reversed in a range from a substantially horizontal direction to a substantially vertical direction by a coating backing roll, evaporated gas of the organic solvent from the coating liquid which flows out of the hopper under the force of gravity and is collected in a region where a three-phase, solid-phase, liquid-phase and gas-phase interface exists around the upper surface of the hopper and the coating point, and evaporated gas from the organic solvent on the coated film, which is moving in the opposite direction from the coating point, is utilized to suppress gas evaporation of the organic solvent in the three-phase interface according to the gas density thereof thereby to prevent the occurrence of stripe-like defects due to solidification of the coating liquid and to stably carry out the coating operation over long periods of time.

DESCRIPTION OF THE PREFERRED EMBODIMENTS

The present invention will be described with reference to its preferred embodiments shown in the accompanying drawings.

Figure 1:
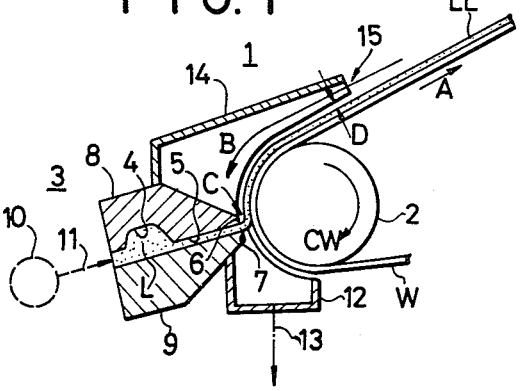
FIG. 1 is a sectional view showing an example of a coating apparatus according to the invention.

An example of a coating apparatus 1 constructed according to the invention as shown in FIG. 1 includes a backing roll 2 which rotates in the direction of the arrow CW to thereby move a web W around the roll 2 and in the direction of the arrow A and an extrusion-type hopper 3. A liquid storing pocket 4 and a slot 5 are formed in the extrusion-type hopper 3. One end of the slot 5 communicates with the pocket 4 while the other end ends at the two edges 6 and 7. The edges 6 and 7 confront the outer surface of the backing roll 2 in such a manner that there is left a small distance or clearance between the backing roll 2 and the edges 6 and 7. The slot 5 extends in the widthwise direction of the web W supported on the backing roll 2.

A coating liquid 1 of an above-described type is supplied under pressure into the pocket 4 in the hopper 3 through a conduit 11 by a metering pump 10. Immediately after the coating liquid L is extruded from the tip end of the slot 5 in the form of a thin liquid layer in which the pressure distribution and the liquid film thickness in the widthwise direction of the web W are completely uniform, the coating liquid L bridges over the distance between the edges 6 and 7 and the web W to form a coating meniscus or bead at the coating point C.

Upon formation of the coating point C, the coating liquid L, which is conveyed away from the coating point C by movement of the web W, is supplemented by the pump 10 without delay.

In order to prevent irregularities in the coating liquid at the coating point C which may be caused by the movement of the web W, the pressure under the coating point C is reduced. For this purpose, a suction chamber 12 is provided on the web entry side of the coating point C. The suction chamber 12 is in the form of a box with its upper surface open the interior of which is connected through a conduit 13 to a pressure reducing source (not shown).

The web W, the backing roll 2, and a part of the lower block 9 of the hopper 3 serve as the upper wall of the suction chamber 12. Therefore, if the front wall and the two side walls of the suction chamber 12 are positioned very close to the coating region on the web W, the upper surface of the suction cbamber 12 provides a suitable pressure difference between the upper and lower surfaces of the coating liquid bridge at the coating point C.

It is well known that a hopper of the above-described type has significant effects as far as increasing the coating rate of the coating liquid and thinning the coated film are concerned. Especially since the path of flow of the coating liquid L from the metering pump 10 to the edges 6 and 7 is through a completely closed system, the hopper 3 is superior to other type hoppers in that unnecessary evaporation of the coating liquid L in the path of flow is prevented. However, the hopper constructed as described above is still unsatisfactory in dealing with the stripe-like defects which, as described before, occur in the region where the three-phase interface exists, that is, in the vicinity of the edges 6 and 7. Accordingly, a variety of improvements have been proposed.

According to the invention, the coating operation of the coating liquid L can be stably continued for a long period of time substantially independently of the pressure of joints and the moving speed of the web W and without temporarily suspending the coating operation for cleaning around the edges 6 and 7.

In particular, this effect can be obtained by providing a hood 14 over the upper block 8 of the hopper 3. As illustrated, the hood 14 is substantially in the form of a box which covers, with at least a width equal to that of the web W, the space from the upper block 8 to a position above the web W. The end face of the hood 14, which is substantially perpendicular to the web W which has passed through the coating point C along the backing roll 2, is open so as to serve as an inlet of an evaporation gas which will be described below. Furthermore, since the upper block 8 and the web W form the lower wall of the hood 14 and the two side walls thereof are spaced a very short distance D from the coated film LL on the web W, the open lower surface of the hood 14 regulates the outlet flow rate of the evaporation gas as is later described.

The coating film LL, formed to a desired thickness beginning with the coating point C on the web W, is released from the closed system and moves in the direction of the arrow A while the above-described organic solvent is evaporating.

As the specific gravity of the evaporation gas is, in general, greater than that of air, the evaporation gas, especially the larger part thereof, is caught by the hood 14 except for evaporation gas moving in the direction of the arrow A together with the coated film LL and the evaporation gas splashed in the widthwise direction of the web W. Furthermore, the evaporation gas which is outside the hood 14 which flows downwardly by its own weight is guided in the direction of the arrow B opposite to the reversal direction A of the web W.

Accordingly, an internal configuration or construction of the hood 14 in which the coating point C is at the lowermost position and in which the walls defining the region in the vicinity of the coating point C are close to the coating point C concentrates the evaporation gas at and around the coating point C thereby increasing the gas density.

As was described above, the evaporated gas collected in the hood 14 suppresses the evaporation of the organic solvent at the coating point C and in the three-phase interface near the coating point according to the gas density. Even if solidified accumulations abruptly appear on the web or the web joining is unsatisfactory so that the coating liquid L oozes out other than at the usual liquid contact surface in the upper block 8, the solidified accumulations are melted again and removed from the solid surface by the evaporation gas in the hood 14 as a result of which the solidified accumulations thus melted are transferred onto the web. Therefore, the occurrence of the above-described stripe-like defects is prevented.

The evaporation gas filling in the hood 14 tends to leak out through the clearance between the coated film LL on the web W and the two side walls of the hood 14. Therefore, it is necessary to construct and position the hood 14 so that the above-described distance D is less than 20 mm in order to quickly reach at the start-up a gas density in the hood 14 at a preferred predetermined level and to maintain the density at such a level.

As the evaporated gas collected in the hood 14 naturally flows downwardly because of the difference in specific gravity between the evaporated gas and air, the dynamic pressure of the gas flow is extremely low. Accordingly, the meniscus or bead at the coating point C never becomes unstable. However, in order to maintain this advantageous effect it is necessary to maintain a gas-tight fit around the suction chamber 12 so as to prevent difficulties due to the evaporated gas in the hood 14 leaking into the suction chamber 12 through the end portions on both sides of the coating point C, that is, the edge portions of the coated film LL, which may cause the dynamic pressure of the gas flow to reach a value which may disturb the meniscus or bead.

Figure 3:
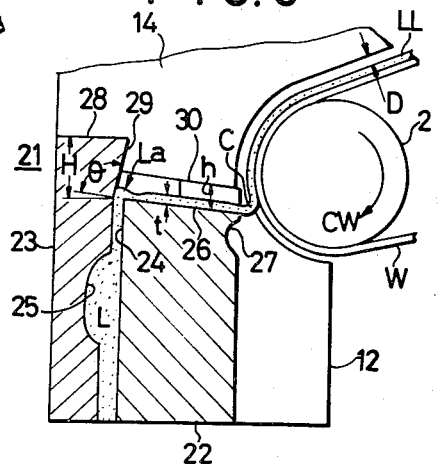
FIG. 3 is an enlarged sectional view of a part of the coating apparatus in FIG. 2.
Figure 2:
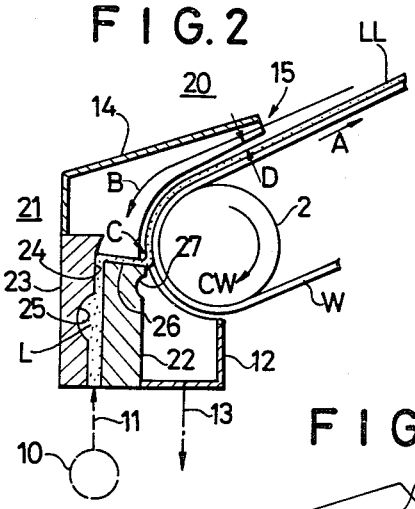
FIG. 2 is a sectional view showing a second example of a coating apparatus according to the invention.
Figure 4:
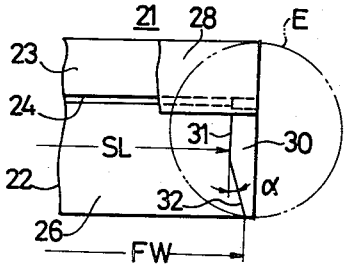
FIG. 4 is a plan view of a slide-type hopper 21 employed in the coating apparatus shown in FIG. 3.
Figure 5:
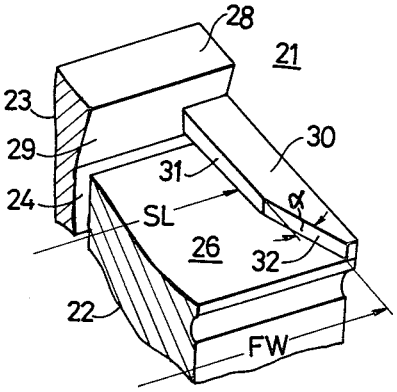
FIG. 5 is an enlarged perspective view illustrating the part E designated in FIG. 4.

Another example of a coating apparatus according to the invention is shown in FIGS. 3 through 5. The arrangement of the coating apparatus 20 is similar to that of the above-described coating apparatus 1 except for the provision of a slide-type hopper 21. Accordingly, a description of the same elements will be omitted but the details of the slide-type hopper 21 will be described fully.

The hopper 21 includes the combination of a front block 22 and a rear block 23, a vertical slot 24 provided in the widthwise direction of the web W, and a pocket 25 communicating with the lower end portion of the slot 24. The slot 24 and the pocket 25 are provided in the combination of the front and rear blocks 22 and 23. The upper surface of the front block 22 forms a slide surface 26. The slide surface 26 is provided so that, when the coating liquid L delivered under pressure into the pocket 25 through the conduit 11 by the pump 10 flows out of the upper end of the slot 24 with the pressure distribution and the film thickness thereof in the widthwise direction of the web W completely uniform, the liquid L is conveyed by the action of gravity and is guided downwardly.

The coating liquid L in the form of a thin film moving down the slide surface 26 bridges between the web W and the edge 27 of the slide surface 26 thereby forming the coating point C. The web W moves in the direction of the arrow A while moving the coating liquid L away from the coating point and supporting the coated film in the form of a uniform and thin film. The coating liquid L is continuously supplied to the coating point C is continuously carried out by the pump 10. For the same pupose as that of the above-described extrusion-type hopper 3, in the hopper 21 the suction chamber 12 is generally constructed so as to cover the region from the coating point C to the entry side of the web W.

It is well known that the hopper 21 of the abovedescribed type is excellent for applying a coating liquid which contains little or no organic solvent described above as far as increasing the coating rate and thinning a coated film is concerned.

Although the path of flow of the coating liquid L from the metering pump 10 to the upper end of the slot 24 occurs within a completely closed system, the path of flow of the coating liquid from the upper end of the slot 24 through the slide surface 26 to the coating point C occurs within a completely open system. Therefore, the coating liquid L evaporates freely after passing through the upper end of the slot 24. Furthermore, in the slide-type hopper, the region where the three-phase (solid-phase, liquid-phase and gas-phase) interface exists is greatly increased by the provision of the slide surface 26. Accordingly, stripe-like defects occur frequently due to the solidified accumulations of the coating liquid L as compared with the case of the extrusion-type hopper 3. Thus, the slide-type hopper without more is unsuitable for the above-described coating liquids.

However, according to the invention, in spite of the increase in area of the region where the three-phase interface exists, the creation of solidified accumulations is suppressed, and the coating liquid L can be stably applied to the web for a long period of time. This is achieved by providing the above-described hood 14 over the front block 22 and the rear block 23 similarly to the case of the extrusion-type hopper 3. The coating operation can be carried out more stably by improving the configuration of the peripheral member forming the slide surface 26.

As illustrated in the figure, the hood 14 is substantially in the form of a box having a width at least equal to that of the web W and covering the space from the upper surface 28 of the rear block 23 to above the web W whose direction of movement is reversed by the backing roll 2. The arrangement of the hood 14 is otherwise substantially the same as that of the extrusion-type hopper 3 described before. Thus, the evaporated gas from the organic solvent contained in the coating liquid L and the coated film LL is collected on the slide surface 2 and in the vicinity of the coating point C thus filling the required space which prevents the solidification of the coating liquid L in the region where the three-phase interface exists and effectively prevents the occurrence of the stripe-like defects in the coated film LL.

As is clear from FIGS. 3 and 5, in accordance with one aspect of the invention the rising angle $\theta$ of the upright wall 29 of the rear block 23, which forms the upper end of the slot 24, is set to be more than 90° and the upright wall is made to protrude above the slide surface 26 with a height at least three times the thickness t of the coating liquid L which flows in the form of a thin film along the slide surface 26. Therefore, the coating liquid La immediately after the slot 24 has, in general, thickness 2 to 2.5 times the thickness t of the coating liquid which flows down the slide surface 26. However, with this arrangement, overflow and oozing of the coating liquid La backwardly behind the coating point are prevented.

A pair of guide plates 30 are provided on both edge portions of the slide surface 26 so that the contracted edge portions of the coating liquid, which flows in the form of a thin layer with a free surface, are expanded in the widthwise direction to provide a coated film having a desired width. The pair of guide plates 30 have side walls 31, respectively, which confront each other. The side walls 31 permit the coating liquid La flowing out of the slot 24 to flow down by its own weight with a slide width which is equivalent to a slot length SL somewhat shorter than the final coating width FW. Each of guide plates 30 has an expanded inside wall 32 which extends to the corresponding side wall 31 and extends outwardly at a suitable angle $\alpha$. The inside wall 32 guides the two edge portions of the coating liquid L. By these expanding inside walls 32, the two edge portions of the coating liquid L contracted by the aforementioned inside walls 31 are corrected to supply the coating liquid in the form of a thin layer having a final coating width FW to the coating point C.

As the above-described three-phase interface exists at the inside wall 31 and the expanding inside wall 32 of each guide plate 30, the rising angle with respect to the slide surface 26 may be set to 90±5 degrees and the rising height h may be set to be in the same range as that of the rising height H of the aforementioned rear block 23. However, it is desirable that the height h be somewhat lower than that of the rear block 23 in view of the gas flow in the hood 14.

The angle $\alpha$ inclined outwardly of the expanding inside wall 32 may be suitably selected according to the physical properties such as the surface tension and viscosity of the coating liquid L. However, the angle is, in general, in the range of from 1 to 10 degrees.

Similar to the above-described extrusion-type hopper, the slide-type hopper 21 according to the invention allows the hood 14 to collect the organic solvent gas evaporated from the coating liquid L and the coated film LL thereby increasing the gas density in the region of the three-phase interface, and suppressing the evaporation of gas in that region. As a result, solidification of the coating liquid L is reduced. Even if the coating liquid is solidified, it is melted again by the gas. Thus, the occurrence of stripe-like defects, which reduces the quality of the final product, is prevented.

The free surface of the coating liquid L which flows down the slide surface 26 is defined on three sides by the upright wall 29 and the guide plates 30. Therefore, overflowing and oozing of the coating liquid are prevented. As the rising angle $\theta$ of the guide plate 30 is made larger than 90 degrees ($\theta > 90°$), the contracted edge portions can be expanded. Therefore, solidification of the coating liquid L which tends to increase the thickness of the edge portions of the coating film is prevented.

As is apparent from the above description, with the method and apparatus according to the invention, in a so-called "hopper coating method" including the slide-type hopper as well as the conventional extrusion-type hopper, the region where the three-phase interface exists above the hopper is filled with the evaporated gas of the organic solvent which is collected by the hood 14. Accordingly, the prevention of solidification of the coating liquid L due to evaporation and re-melting of the solidified accumulations are continuously carried out by the gas. Thus, the method and apparatus according to the invention is meritorious in that the coating liquid L can be applied stably for long periods of time.

The present invention has the following additional effects. The free surface of the coating liquid L, which flows down the relatively large slide surface 26 of the slide-type hopper 21, is defined in three direction by the upright wall 29 and the guide plates 30 which correct the contracted edge portions of the coating liquid in the form of a thin film whereby overflowing and oozing of the coating liquid are prevented. Therefore, solidifying of the coating liquid L due to evaporation and increases in the thickness of the edge portion can be prevented.

Furthermore, the present invention, unlike a coating apparatus utilizing a conventional extrusion-type hopper, employs no components which are difficult to machine and operate such as would make it necesssary to provide means for recovering excessive amounts of coating liquid and to form a recess in the vicinity of the edge of the hopper, for instance. That is, the invention can achieve its object merely by adding a simple and compact hood 14 as shown in the figures as described above.

In order to clarify the novel effects of the invention, specific examples will be described.

EXAMPLE I

With the apparatus as shown in FIG. 1, a coating liquid having the following composition was applied to a supporting member of polyethyleneterephthalate and the supporting member was inspected to determine whether stripe-like defects were present on the coated film. The results are as indicated in Table I.

| Coating Liquid Composition | Parts by Weight |
|---|---|
| Cellose diacetate | 6 |
| Acetone | 74 |
| Cyclohexane | 20 |
| Effective volume in the hood | 2 liters |
| Coating liquid viscosity | 100 cp |
| Amount of coating | 60 to 120 cc/m$^2$ |
| Coating rate | 30 m/min |
| Suction chamber pressure | −5 to −50 mm/Aq |

In Table I below there is shown the amount of coating, the web advancing angle (°), the hood clearance (D), and the stripe-like defect inspection results (pieces/m).

TABLE I

| Sample No. | Amount of Coating | Web advancing Angle (°) | Hood Clearance (D) | Stripe-like Defect Inspection Result (pieces/m) | | | |
|---|---|---|---|---|---|---|---|
| | | | | 12hrs | 24 hrs | 36 hrs | 48 hrs |
| 1 | 60cc/m$^2$ | 2 | 25m/m | 0 | 0 | 0.2 | 0.8 |
| 2 | 60 | 2 | 20 | 0 | 0 | 0 | 0 |
| 3 | 60 | 2 | 15 | 0 | 0 | 0 | 0 |
| 4 | 60 | 45 | 25 | 0 | 0 | 0 | 0.4 |
| 5 | 60 | 45 | 20 | 0 | 0 | 0 | 0 |
| 6 | 60 | 45 | 15 | 0 | 0 | 0 | 0 |
| 7 | 60 | 100 | 25 | 0 | 0 | 0 | 0.4 |

TABLE I -continued

| Sample No. | Amount of Coating | Web advancing Angle (°) | Hood Clearance (D) | Stripe-like Defect Inspection Result (pieces/m) 12hrs | 24 hrs | 36 hrs | 48 hrs |
|---|---|---|---|---|---|---|---|
| 8 | 60 | 100 | 20 | 0 | 0 | 0 | 0 |
| 9 | 60 | 100 | 15 | 0 | 0 | 0 | 0 |
| 10 | 120cc/m$^2$ | 2 | 25 | 0 | 0 | 0.1 | 0.6 |
| 11 | 120 | 2 | 20 | 0 | 0 | 0 | 0 |
| 12 | 120 | 2 | 15 | 0 | 0 | 0 | 0 |
| 13 | 120 | 45 | 25 | 0 | 0 | 0 | 0.4 |
| 14 | 120 | 45 | 20 | 0 | 0 | 0 | 0 |
| 15 | 120 | 45 | 15 | 0 | 0 | 0 | 0 |
| 16 | 120 | 100 | 25 | 0 | 0 | 0.2 | 0.6 |
| 17 | 120 | 100 | 20 | 0 | 0 | 0 | 0 |
| 18 | 120 | 100 | 15 | 0 | 0 | 0 | 0 |

EXAMPLE II

With the coating apparatus 20 as shown in FIGS. 2 through 5, a coating liquid having the following composition was applied to the same supporting member as in Example I. The supporting member was inspected to determine whether or not the stripe-like defects were present. The results of the inspection are as indicated in Table II.

| Coating Liquid Composition | Parts by Weight |
|---|---|
| Styrene and N, N, N-tri-N-hexyl-N-vinylbenzylammonium chloride copolymer | 5 |
| Ethanol | 45 |
| Acetone | 5 |
| Gelatin | 5 |
| Water | 40 |
| Effective volume in the hood | 2 liters |
| Coating liquid viscosity | 20 cp |
| Amount of coating | 90 cc/m$^2$ |
| Coating rate | 30 m/min |
| Suction chamber pressure | −10−−50 m/mAq |
| Web advancing angle | 5° |

In the Table II below there is the defect inspection results (pieces/m), the amount of coating, the coated film thickness, the hood clearance (D), the rising angle ($\theta$), and the rising height (h).

From the results indicated in Tables I and II, the following effects in common with the two coating apparatuses have been found.

(1) The coating operation can be continued stably for more than twenty-four hours owing to the provision of the hood.

(2) The coating operation can be continued stably for more than thirty-six hours by making the hood clearance (D) less than 20 mm.

(3) No particular difference in stripe-like defects is observed when the web advancing angle is anywhere from the horizontal direction to the vertical direction.

Furthermore, it has been found from Table II that it is desirable that the rising angle of the rear block 23 and the rising height of the guide plate 30 in the slide-type hopper be 90 to 120 degrees and more than twice the coated film thickness (t), respectively.

What is claimed is:

1. A method for applying a film forming material including a coating liquid having an organic solvent of high volatility directly or through other coated films to a web which is continuously conveyed, comprising the steps of forming a coated film on said web by applying said coating liquid thereto by means of an extrusion-type hopper while changing the direction of conveyance of said web in a range of from a substantially horizontal direction to a substantially vertical direction by a coating backing roll, collecting, by means of a hood, evaporated gas of the organic solvent from said coating

TABLE II

| Sample No. | Amount of Coating | Coated Film Thickness (t)** | Hood Clearance (D) | Upright wall (29) & Guide plate (30) Rising Angle($\theta$) | Rising Height (h) | Stripe-like Defect Inspection Result (pieces/m) 12 hrs | 24 hrs | 36 hrs | 48 hrs |
|---|---|---|---|---|---|---|---|---|---|
| 1 | 90cc/m$^2$ | 1600μ | 25m/m | 80° | 3200μ | 0.1 | 0.4 | 1.2 | 2.5 |
| 2 | 90 | 1600 | 25 | 80 | 1600 | 0.2 | 0.8 | 1.5 | 3.0 |
| 3 | 90 | 1600 | 25 | 95 | 3200 | 0 | 0 | 0.8 | 1.6 |
| 4 | 90 | 1600 | 25 | 95 | 1600 | 0 | 0 | 1.4 | 2.0 |
| 5 | 90 | 1600 | 25 | 100 | 3200 | 0 | 0 | 0.2 | 0.6 |
| 6 | 90 | 1600 | 25 | 100 | 1600 | 0 | 0 | 0.4 | 0.8 |
| 7 | 90 | 1600 | 25 | 105 | 3200 | 0 | 0 | 0.1 | 0.8 |
| 8 | 90 | 1600 | 25 | 105 | 1600 | 0 | 0 | 0.4 | 0.6 |
| 9 | 90 | 1600 | 25 | 120 | 3200 | 0 | 0 | 0 | 0.1 |
| 10 | 90 | 1600 | 25 | 120 | 1600 | 0 | 0 | 0.2 | 0.4 |
| 11 | 90 | 1600 | 15 | 80 | 3200 | 0.1 | 0.3 | 1.0 | 1.8 |
| 12 | 90 | 1600 | 15 | 80 | 1600 | 0.2 | 0.8 | 1.8 | 2.6 |
| 13 | 90 | 1600 | 15 | 95 | 3200 | 0 | 0 | 0.4 | 0.8 |
| 14 | 90 | 1600 | 15 | 95 | 1600 | 0 | 0 | 0.4 | 1.2 |
| 15 | 90 | 1600 | 15 | 100 | 3200 | 0 | 0 | 0 | 0 |
| 16 | 90 | 1600 | 15 | 100 | 1600 | 0 | 0 | 0 | 0.4 |
| 17 | 90 | 1600 | 15 | 105 | 3200 | 0 | 0 | 0 | 0 |
| 18 | 90 | 1600 | 15 | 105 | 1600 | 0 | 0 | 0 | 0.2 |
| 19 | 90 | 1600 | 15 | 120 | 3200 | 0 | 0 | 0 | 0 |
| 20 | 90 | 1600 | 15 | 120 | 1600 | 0 | 0 | 0.1 | 0.2 |

**on the slide surface liquid which flows out of said hopper in a region where a three-phase, solid-phase, liquid-phase and gas-phase interface exists around the upper surface of said hopper and at a coating point, and suppressing, by means of said hood, gas evaporation in said region with evaporated gas of said organic solvent from said coated film which is moving in said vertical direction from said coating point, thereby to prevent the occurrence of stripe-like defects due to solidification of said coating liquid in said region and to stably carry out the coating operation.

2. A coating apparatus for applying a film forming material including a coating liquid having an organic solvent of high volatility to a web comprising: a backing roll for moving a web to which a coating liquid is to be applied while changing the direction of conveyance of said web; a hopper in which at least the flow path of said coating liquid from a metering pump to a slot outlet is of a completely closed system; and a hood for covering a region and a volume above said region which is on said web downstream of a coating point which is formed by said coating liquid bridged between an edge of said hopper and said web and in which region a three-phase, solid-phase, liquid-phase and gas-phase, interface exists, said hood being adapted for collecting gas from organic solvent evaporation from said coating liquid and coated film in said region where said three-phase interface exists, said evaporation gas thus collected being utilized to prevent solidification of said coating liquid to perform a stable coating operation.

3. An apparatus as claimed in claim 2 wherein said hopper comprises a slide surface, said slide surface being bounded on three generally horizontal sides by a rear wall of a rear block of said hopper and a pair of guide plates of said hopper to prevent oozing and solidification of said coating liquid.

4. An apparatus as claimed in claim 3 wherein the rising angle of said rear wall with respect to said slide surface is within the range of 90° to 120°.

5. An apparatus as claimed in claim 3 wherein the height of said guide plate is less than the height of said rear wall.

6. An apparatus as claimed in claim 3 wherein said guide plates each comprises a side wall having an outwardly expanded portion.

7. An apparatus as claimed in claim 6 wherein the angle of expansion of each of said side walls is in a range of 1° to 10°.

8. A method for applying a film forming material including a coating liquid having an organic solvent of high volatility directly or through other coated films to a web which is continuously conveyed, comprising the steps of forming a coated film on said web by applying said coating liquid thereto by means of a slide-type hopper while the direction of conveyance of said web is changed from a substantially horizontal direction to a substantially vertical direction by a coating backing roll, collecting, by means of a hood, evaporated gas of the organic solvent from said coating liquid which flows out of said hopper in a region where a three-phase, solid-phase, liquid-phase and gas-phase interface exists around the upper surfact of said hopper and at a coating point, and suppressing, by means of said hood, gas evaporation in said region with evaporated gas of said organic solvent from said coated film which is moving in said vertical direction from said coating point thereby to prevent the occurrence of stripe-like defects due to solidification of said coating liquid in said region and to stably carry out the coating operation.

9. A method as claimed in claim 8 wherein said hopper comprises a slide surface, said slide surface being bounded on three generally horizontal sides by a rear wall of a block of said hopper and a pair of guide plates of said hopper to prevent oozing and solidification of said coating liquid.

10. A method as claimed in claim 9 wherein the rising angle of said rear wall with respect to said slide surface is within the range of 90° to 120°.

11. A method as claimed in claim 9 wherein the height of each said guide plate is less than the height of said rear wall.

* * * * *